United States Patent [19]

Ueda

[11] Patent Number: 4,674,986

[45] Date of Patent: Jun. 23, 1987

[54] MODEL FLYING VEHICLE WITH SMOOTH LANDING

[76] Inventor: Ksaku Ueda, 8 Hachioji 1-chome, Ikeda-city, Osaka 563, Japan

[21] Appl. No.: 756,072

[22] Filed: Jul. 17, 1985

[51] Int. Cl.[4] ..... A63H 27/22

[52] U.S. Cl. ..... 446/39; 446/60

[58] Field of Search ..... 244/17.11, 17.13, 17.15, 244/17.25, 19; 446/36, 37, 39, 40, 42–45, 57–59, 60

[56] References Cited

U.S. PATENT DOCUMENTS

| | | | |
|---|---|---|---|
| 1,669,758 | 5/1928 | Isacco et al. | 244/17.11 |
| 2,308,916 | 1/1943 | Halligan et al. | 446/44 |
| 2,389,170 | 11/1945 | Stalkes | 244/17.13 |
| 2,537,393 | 1/1951 | Bisch et al. | 446/40 |
| 2,620,592 | 12/1952 | Goedecker et al. | 446/43 |
| 2,931,132 | 4/1960 | Griessl | 446/40 |
| 3,108,641 | 10/1963 | Taylor | 446/37 |

FOREIGN PATENT DOCUMENTS

| | | | |
|---|---|---|---|
| 285090 | 7/1965 | Australia | 244/17.13 |
| 716768 | 8/1965 | Canada | 446/37 |
| 2269986 | 5/1974 | France | 446/37 |
| 751828 | 7/1956 | United Kingdom | 446/43 |

*Primary Examiner*—James R. Feyrer

*Attorney, Agent, or Firm*—Birch, Stewart, Kolasch & Birch

[57] ABSTRACT

Disclosed is model flying vehicle wherein the main wing returns from the slanting position (that is, with a proper elevation angle) to the flat position when the power is disengaged, thereby ensuring stable and smooth landing without impact or damage to the flying body or the wing.

9 Claims, 7 Drawing Figures

MODEL FLYING VEHICLE WITH SMOOTH LANDING

BACKGROUND OF THE INVENTION

This invention relates to a model flying vehicle, and more particularly to a model flying vehicle with a configuration for stabilization of the vehicle during landing.

Model flying vehicles especially helicopter toys are given a sufficient force of lift to take off through a source of power such as a twisted rubber coil. However, special and careful attention is not paid to a landing mechanism for the vehicle. The conventional vehicle descents while the elevation angle of the main wings remains the same as that during takeoff, the vehicle will land under an unstable state (that is, at an angle with respect to the ground) and in some cases the flying body will whirl several times prior to landing. It is, therefore, highly likely that the flying body will be subject to a big impact during landing and the flying body, the main wings or the tail wings will be damaged.

OBJECT OF THE INVENTION

Accordingly, it is an object of the present invention to provide a model flying vehicle which can achieve a stable landing.

It is another object of the present invention to provide a model flying vehicle which can descend naturally due to gravity while floating in the sky, without any impact during landing.

To achieve the foregoing objects, the flying vehicle structure according to the present invention is provided which comprises a flying body, wing means secured on said flying body for rotation, and a source of power for providing the force of rotation and thus the force of lift to said wing means. A mechanism is provided for reducing the elevation angle of said wing means when said source of power is disenabled, and for stabilizing said flying body during landing.

In particular, when the source of power is disenabled, the elevation angle of the wing means is reduced into a zero (a flat state), permitting the flying body to descend naturally only due to its gravity and with a high degree of stability as if it floats in the sky. This avoids the objectionable situation where the flying body bumps against the ground with a high impact and the flying body or the wing means become damaged or battered.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE INVENTION

Figure 1:
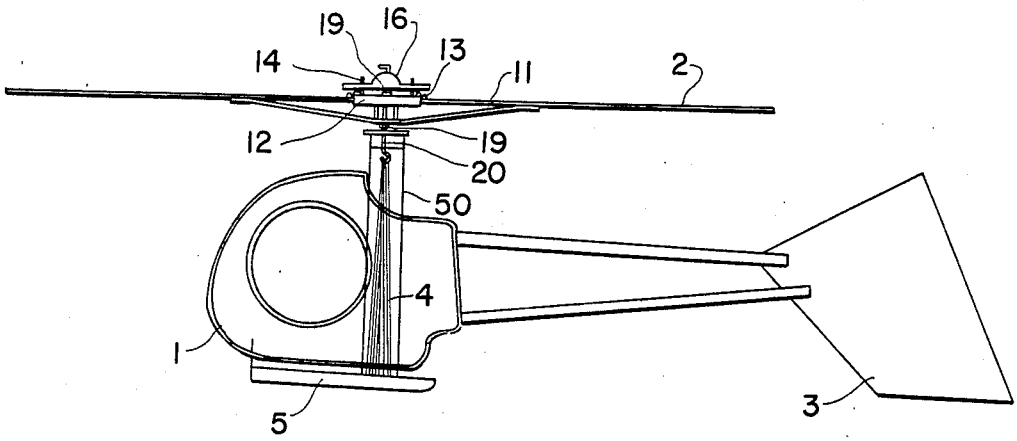
FIG. 1 is a side view of a flying vehicle according to an embodiment of the present invention.
Figure 2:
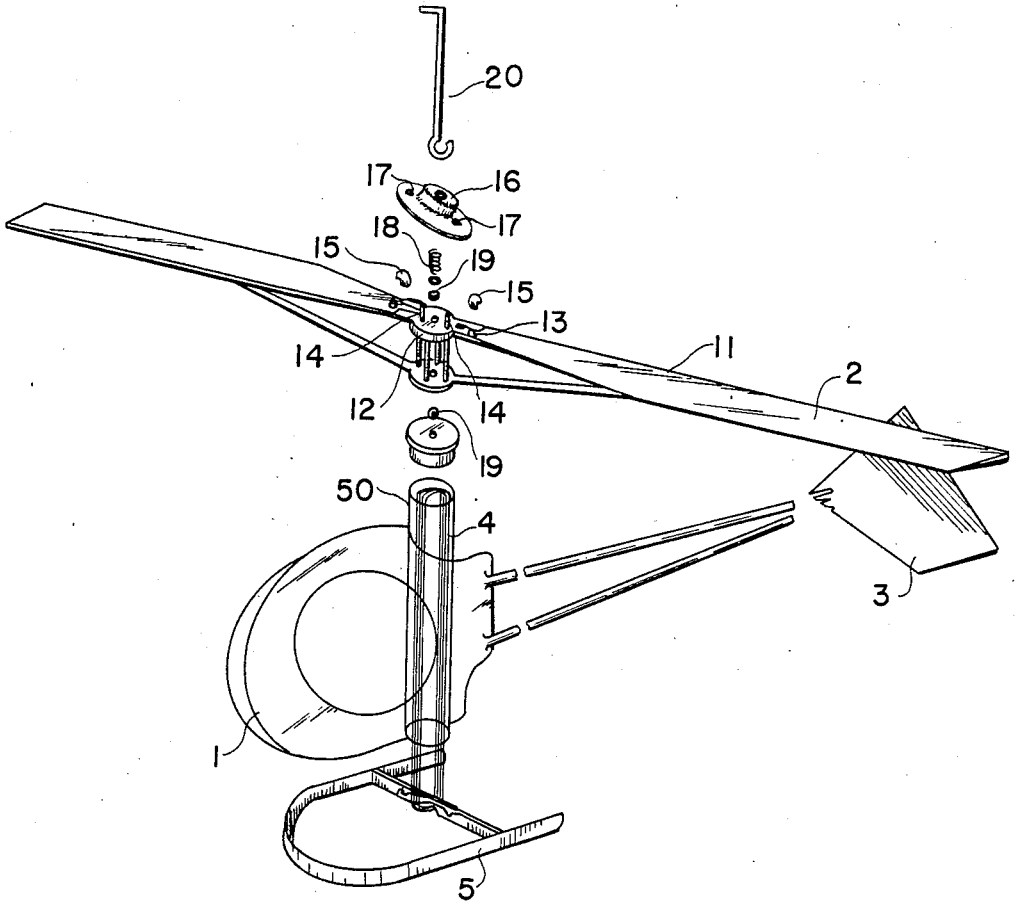
FIG. 2 is an exploded perspective view of the flying vehicle as indicated in FIG. 1.
Figure 4A:
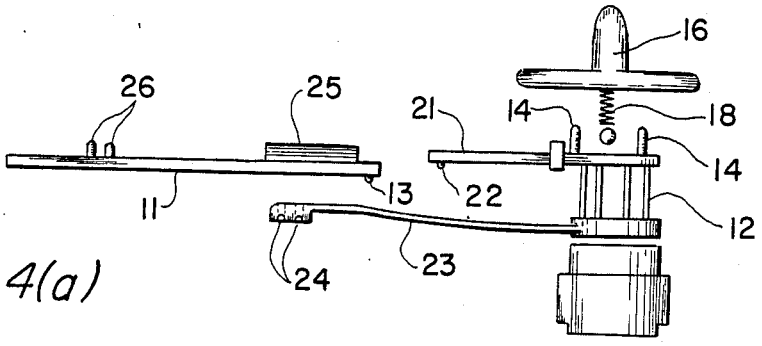
FIGS. 4(*a*) to 4(*d*) show how to assemble a main wing in the flying vehicle as shown in FIGS. 1 and 2.
Figure 4B:
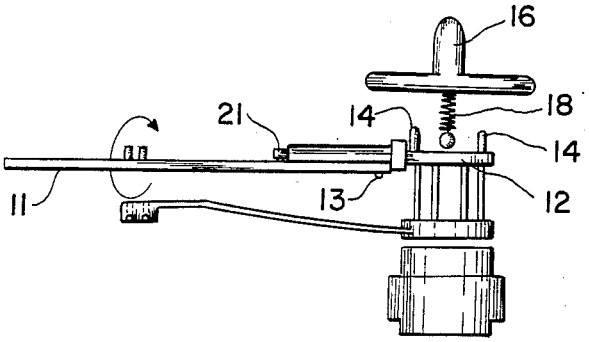
Figure 4C:
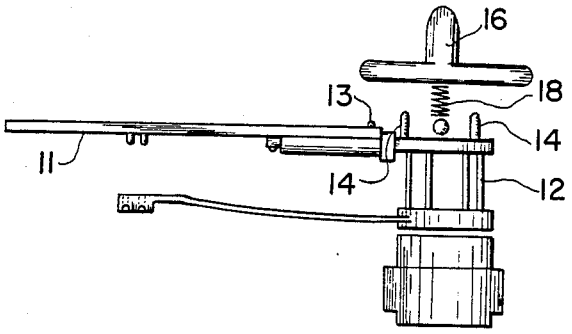
Figure 4D:
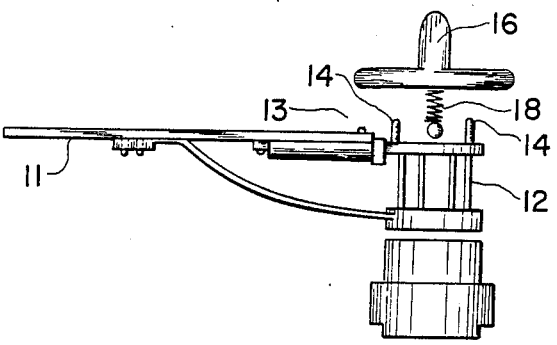

In FIGS. 1 and 2, illustrate a side view and exploded perspective view of a flying vehicle, a helicopter toy, according to an embodiment of the present invention.

The flying vehicle generally comprises a flying body 1, a main wing 2, a tail wing 3, a power source 4 such as twisted rubber and a leg 5. The entire flying vehicle except some components are made from plastic molding and designed into such a shape and weight that the vehicle may be easily given a lifting force. As best shown in FIG. 2, the main wing 2 has a pair of blades 11, 11 each having a projection 13, 13 in the vicinity of the periphery of a spindle portion 12.

The main wing 2 is made of plastic moldings as described above, which moldings are so flexible that its elevation angle is easily variable. The spindle portion 12 of the main wing 2 is molded separately from the blade portions 11, 11 and shaped into a cylinder with a pair of engaging pawls 14, 14 at the top of the spindle portion 12. The blade portions 11, 11 and the spindle portion 12 are jointed into a single unit through the use of joints 15, 15. Disposed over the main wing 2 is a cap member 16 which has on the bottom a pair of openings 17, 17 for receiving the engaging pawls 14, 14 therein. The stem portion of the cap member 16 is also adapted to receive a spring 18 therein.

Figure 3:
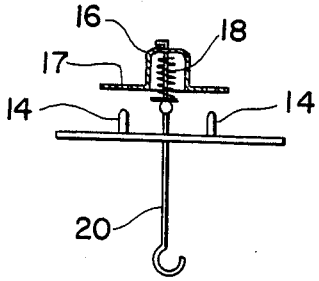
FIG. 3 is a cross sectional view of a shaft assembly in the flying vehicle.

The rubber coil of the power source 4 is secured in the following manner. While the spring 18 is inserted into the stem portion of the cap member 16 and a pair of spacers 19, 19 are secured above and below the spindle portion 12 of the main wing 2, a shaft 20 is positioned to pass through the center of the spindle portion 12 and the cap member 16 with its upper end engaging into the cap member 16 and a hook at its lower end extending into a stud 21 at the center of the flying body 1. The rubber coil 4 is wound between the hooked lower end of the shaft 20 and the leg 5. FIG. 3 depicts in more detail the shaft 20 secured in the above manner.

To supply energy for enabling the take off of the vehicle, the operator places the engaging pawls 14, 14 into alignment with the openings 17, 17 in the cap member 16 and winds up the rubber coil 4 by rotating the main wing 2 while holding the body 1. As the rubber coil 4 is wound, the main wing 2 is forced down together with the cap member 16 by the force of the twisted rubber coil. Because of the projections on the cap member 16 being in contact with the counterparts 13, 13 on the main wing 2, the periphery of the projections on the blade portions are pushed down to provide the main wing with a given elevation angle. Upon detaching the individual's hand from the main body after windup of the rubber coil 4, the flying body 1 is given thrust by the rubber coil 4 and lift by the elevation angle of the main wing, thus starting take-off. When this occurs, the pawls 14, 14 of the spindle portion 12 are kept in engagement with the openings 17, 17 in the cap member 16 so that the flying body 2 can keep ascending due to the proper elevation angle of the main wing 2.

If the rubber coil 4 is fully unwound or the power source is disengaged, the flying body 1 losses the thrust and starts descending. Under these circumstances, the rubber coil 4 has no pulling power so that the spring 18 is allowed to hoist the cap member 16 and disengage the pawls 14, 14 of the spindle portion 12 from the openings 17, 17 in the cap member 16. Upon such disengagement, there is nothing that pushes down the projections 13, 13, so that the blade portions 11, 11 of the main wing resume a flat state due to its flexibility. The result is that the whole of the flying vehicle descends natually only due to gravity while maintaining a stable flying position in the sky. There is no likelihood of the flying body losing balance or abruptly whirling during landing. The impact on the flying body during landing is reduced to a minimum, whereby damage to the vehicle is prevented.

FIGS. 4(*a*) to 4(*d*) illustrate how to assemble the main wing 2. As described above, the main wing 2 comprises the spindle portion 12 and the blade portions 11 both molded separate from each other. It is clear from FIG. 4(*a*) that the spindle portion 12 further has an insert 21 with a stop 22 at a higher level and a stay 23 with a pair of openings 24, 24 at a lower level. The blade portion 11, on the other hand, further includes a curved groove 25 and a pair of projections 26, 26 which are to be received within the respective openings 24, 24 in the stay 23. First of all, the blade portion 11 is placed topside down, with the curved groove receiving the insert 21 of the spindle portion 12. At this moment, the stop 22 extends out of the groove 25 so that the blade portion 11 is prevented from separating from the spindle portion 12. Then, the blade portion 11 is turned by 180 degrees as indicated in FIG. 4(*b*) so as to place the projections 26, 26 into alignment with the openings 24, 24. Finally, the tip of the stay 23 (that is, the openings) are tightly secured into the projections 26, 26. It is important to note that the stay 23 itself is flexible and forces the blade portion 11 to a flat position when the power source is disenabled or when the pawls 14, 14 of the spindle portion 12 are disengaged from the openings 17, 17 in the cap member 16. Another important function of the stay 23 is to keep the blade portion 11 from moving to a vertical direction.

As stated above, according to the present invention, the main wing returns from the slanting position (that is, with a proper elevation angle) to the flat position when the power is disengaged, thereby ensuring stable and smooth landing without impact or damage to the flying body or the wing.

Whereas in the foregoing description the flying vehicle using the rubber coil as the source of power has been shown and described, the present invention is equally applicable to other types of vehicles which utilizes a motor or the like as the source of power.

The invention being thus described, it will be obvious that the same may be varies in many ways. Such variations are not to be regarded as a departure from the spirit and scope of the invention, and all such modifications are intended to be included within the scope of the following claims.

What is claimed is:

1. A model flying vehicle structure comprising:

a flying body;

a spindle portion mounted on said flying body for rotation;

wing means secured to said spindle portion for rotation therewith, said wing means comprising at least two blade portions;

a shaft extending through said spindle portion;

an elastic member operatively connected to said flying body and said shaft for providing a force of rotation to said spindle portion and said wing means for elevating said flying body by lift produced by said rotating wing means;

a cap member axially movable on said shaft;

spring means disposed between said spindle portion and said cap member for normally biasing said cap member out of engagement with said spindle portion; and projections disposed on one side of an upper surface of each blade portion for selective engagement with said cap member;

wherein manually rotating said wing means relative to said flying body imparts a twist to said elastic member for providing stored energy for rotating said spindle portion and said wing means while displacing said cap member into engagement with said spindle portion and camming engagement with said projections on said wing means for varying the elevation angle of said wing means relative to said flying body for initially enabling said wing means to lift said flying body in flight and subsequently permitting said spring means to disengage said cap member from said spindle portion and said projections on said wing means for decreasing the elevation angle to permit said flying body to land without a significant impact.

2. A model flying vehicle according to claim 1, wherein said wing means are normally not engaged by said cap member except when a sufficient rotation is imparted to said elastic member to overcome the force exerted by said spring means.

3. A model flying vehicle according to claim 1, wherein said spindle portion includes outwardly projecting inserts and said wing means includes curved grooves affixed thereto, said curved grooves being mounted on said inserts to permit limited rotation between said wing means and said spindle portion.

4. A model flying vehicle according to claim 1, and further including stays affixed to said spindle portion and to said wing means for restoring the position of said wing means relative to said spindle portion after said cap member is disengaged from said projections on said wing means.

5. A model flying vehicle according to claim 4, wherein said stays are flexible and force said wing means to a predetermined angular relationship relative to said spindle portion.

6. A model flying vehicle according to claim 1, and further including a first spacer disposed between said spindle portion and said flying body and a second spacer disposed between said spindle portion and said cap member.

7. A model flying vehicle according to claim 1, and further including engaging pawls affixed to said spindle portion and projecting toward said cap member, and legs affixed to said cap member and projecting outwardly therefrom, said legs include apertures for engaging said engaging pawls and positioning said legs for engagement with said projections on said wing means.

8. A model flying vehicle according to claim 1, wherein said flying body is a helicopter and said wing means are rotors.

9. A model flying vehicle according to claim 1, wherein said elastic member is a rubber band.

* * * * *